US010286926B2

(12) United States Patent
Blengini

(10) Patent No.: US 10,286,926 B2
(45) Date of Patent: May 14, 2019

(54) CONTINUOUSLY MOVING CABLEWAY

(71) Applicant: DIMENSIONE INGENIERIE S.R.L., Turin (IT)

(72) Inventor: Sergio Blengini, Courmayeur (IT)

(73) Assignee: DIMENSIONE INGENIERIE S.R.L., Turin (IT)

( * ) Notice: Subject to any disclaimer, the term of this patent is extended or adjusted under 35 U.S.C. 154(b) by 87 days.

(21) Appl. No.: 15/307,461

(22) PCT Filed: Feb. 18, 2015

(86) PCT No.: PCT/IB2015/051234
§ 371 (c)(1),
(2) Date: Oct. 28, 2016

(87) PCT Pub. No.: WO2015/166357
PCT Pub. Date: Nov. 5, 2015

(65) Prior Publication Data

US 2017/0050646 A1 Feb. 23, 2017

(30) Foreign Application Priority Data

May 2, 2014 (IT) ..... TO2014A0355

(51) Int. Cl.
*B61B 1/00* (2006.01)
*B61B 3/00* (2006.01)
(Continued)

(52) U.S. Cl.
CPC ..... *B61B 12/022* (2013.01); *B61B 3/00* (2013.01); *B61B 7/04* (2013.01); *B61B 7/06* (2013.01);
(Continued)

(58) Field of Classification Search
CPC ..... B61B 12/022; B61B 3/00; B61B 7/04; B61B 7/06; B61B 12/002; B61B 12/10; B61B 1/00
See application file for complete search history.

(56) References Cited

U.S. PATENT DOCUMENTS 3,983,978 A * 10/1976 Uchiyama ..... B60L 5/08 104/112
4,641,584 A * 2/1987 Bertrand ..... B61B 12/105 104/173.2
(Continued)

FOREIGN PATENT DOCUMENTS

DE 846854 8/1952
EP 1930225 11/2008
(Continued)

OTHER PUBLICATIONS

International Search Report, dated Oct. 6, 2015.

*Primary Examiner* — Jason C Smith
(74) *Attorney, Agent, or Firm* — Valauskas Corder LLC

(57) ABSTRACT

In a continuously moving cableway installation (9), a haul rope (13*b*) extends as a closed loop defining a transportation path (12). Suspended vehicles (14) can be connected to the rope by means of automatic coupling devices (24). Along the rope path, passenger stations (10) are provided, each providing ramps (22) to cause the clamping or release of the automatic coupling devices (24), fixed power supply conductors (30), and overhead rails (28). Mounted on board each vehicle (14) are: a motor-driven trolley (20), an electrical contact (30*a*) to contact one of the power supply conductors (30) in the passenger stations (10), an electric power battery (43), and an electric motor (42) with driving wheels (40) associated thereto, which are suitable for rolling
(Continued)

on the overhead rails (28) in order to move the vehicle within and proximate to the passenger stations.

9 Claims, 6 Drawing Sheets

(51) Int. Cl.

| | |
|---|---|
| ***B61B 7/04*** | (2006.01) |
| ***B61B 7/06*** | (2006.01) |
| ***B61B 12/00*** | (2006.01) |
| ***B61B 12/02*** | (2006.01) |
| ***B61B 12/10*** | (2006.01) |

(52) U.S. Cl.
CPC ..... *B61B 12/002* (2013.01); *B61B 12/10* (2013.01); *B61B 1/00* (2013.01)

(56) References Cited

U.S. PATENT DOCUMENTS 4,699,064 A * 10/1987 Tarassoff ..... B61B 12/105 104/163
4,760,798 A * 8/1988 Blengini ..... B61B 12/122 104/209
4,785,738 A * 11/1988 Mollet ..... B61B 12/022 104/172.4
8,522,689 B2 * 9/2013 Beck ..... B61B 12/105 104/112
2011/0083577 A1 * 4/2011 Tilley ..... B61B 7/06 104/96
2012/0266776 A1 * 10/2012 Peterson ..... B60L 13/03 105/149.2
2016/0096532 A1 * 4/2016 Cylvick ..... B61B 12/007 104/117
2017/0050646 A1 * 2/2017 Blengini ..... B61B 7/06

FOREIGN PATENT DOCUMENTS

| | | |
|---|---|---|
| EP | 1992539 | 11/2008 |
| EP | 2148801 | 2/2010 |
| FR | 2927597 | 8/2009 |
| WO | 2011/003812 | 1/2011 |

* cited by examiner

CONTINUOUSLY MOVING CABLEWAY

TECHNICAL BACKGROUND

The present invention relates, in general, to the field of transportation systems; particularly, this invention relates to a continuously moving aerial cableway.

PRIOR ART

The quality of life in urban areas and the development potential of the latter is strictly connected to the efficiency and capillarity of the public transportation network. However, in urban areas, public transportation systems are challenged by private mobility, which offers a greater flexibility of use than collective transporting means, despite it is much more expensive and leads to well-known issues of pollution and traffic congestion.

Building extensive and capillary transportation networks in the megalopolises of developing countries is of utmost importance. These major cities have frequently expanded in a chaotic manner across areas of complex orography, where traditional metropolitan railways and/or tramways cannot be implemented due to major differences in ground levels and the critical issues of the road network are such as to prevent bus lines (buses and trolleybuses) from being put in place. Despite the rapid growth of these cities and the technical progress of the last century, not enough advancements have been made in urban transportation systems.

Cableways, particularly of the automatic clamping type, are traditional urban public transporting means, wherein a driving rope pulls a vehicle along a predetermined path, which can be either aerial or terrestrial. In the latter case, the installation is funicular and the vehicle travels along rails situated on the ground.

EP 2 148 801 B1 discloses an installation of the above-mentioned type, which adds the possibility of using the traction applied by the rope to supply the auxiliary services (air conditioning, lighting, etc.) provided on board the vehicle to the traditional configuration of a terrestrial funicular transporting means; the wheels rotatably driven by the rope actually act as electric power generators for the vehicle auxiliary devices.

However, terrestrial installations require tracks occupying the ground; this results in considerable issues related to urban road network, because these systems and the vehicle traffic hinder each other, both on promiscuous and dedicated roads. In the latter case, considerable restrictions would be imposed to the transporting means circulation. Furthermore, terrestrial cableways entail the execution of expensive excavation works, also due to the presence of pipings and cables passing below the road surface.

On the other hand, aerial installations have a low impact on the ground and allow passing over critical or sensible areas such as water courses and residential areas without requiring road infrastructures.

Accordingly, while terrestrial installations suffer from the same construction limitations as traditional tramways and subways, aerial installations have a greater potential for applications, thus allowing solutions that are not feasible with terrestrial systems.

The use of this type of installations in urban areas has strong limitations, among which the relatively short paths, the presence of few access points along the line, the difficulty of building a transportation network that integrates various lines, and the short time interval during which these systems are operative. The aerial or suspended vehicle installations are mainly used in ski resorts, where considerable differences of level need to be addressed with relatively short paths and high hourly rates, but with operation times that are normally limited to daylight time in winter and summer tourist seasons, whereas a considerably greater operative time is required for urban transportation.

Aerial and automated clamping installations are characterised by very complex stations and lines, with a multitude of rollers and moving devices; the interruption, or anomaly, of any of the many rollers or station devices fatally causes the installation to stop and the service to be interrupted. Accordingly, these installations require much preventive maintenance and have a sensibly lower degree of reliability as compared with funicular railways and cableways. While being conceptually suitable for providing linear systems or being part of a network with intermediate stations and branches, aerial cableways are not suitable in the practice, because the sum of the failure likelihood obtained by putting a number of consecutive line sections "in series" exponentially reduces the functional reliability thereof. Lastly, since the stations are an important component of the installation cost, an increase in the number thereof, aimed at having similar service conditions as those obtained with other types of public transportation, would increase the cost thereof. Due to these limitations, the use of cableways for urban transportation is not convenient for urban transportation, as compared with conventionally used solutions.

SUMMARY OF THE INVENTION

An object of the present invention is to overcome the above-mentioned problems, by proposing a flexible, cost-effective, and reliable solution with a very low impact on the mobility on the ground.

In order to obtain this result, according to an aspect of the invention, a vehicle suspended from an aerial hauling rope is provided with motor-driven wheels, which can either brake or accelerate the vehicle at the passenger access stations and drive it through these stations.

With conventional installations, particularly of the aerial automated clamping type (cablecars, chairlifts etc.), the slowing down and acceleration of the vehicles is provided by a set of rollers sequentially arranged within the passenger access stations. The rollers are cascade-connected, such as to have angular velocities progressively decreasing along the braking section and increasing along the acceleration section. The contact between the rollers and the flanges integral with the vehicle causes the acceleration thrust or the deceleration counter-thrust. The rollers take the motion from the haul rope, by means of a transmission that permanently keeps them in rotation.

The continuous movement of these parts causes a sensible waste of energy, in addition to dramatically increasing the risk that a failure may stop the installation, especially if the installation comprises a high number of stations (which is a normal requirement for an urban transportation system). Approximately, a station uses several tens of kWh a day only to maintain the permanent motion of the acceleration and deceleration rollers and chain haulage systems which cause the vehicles to travel into the station at slow speed.

A suspended vehicle (for example, a cabin of a gondola lift system), provided with motor-driven wheels according to the invention, makes acceleration and braking rollers unnecessary, since the vehicle is capable of stopping and restarting autonomously when it is released from the haul rope, as well as carrying out small movements within the stations (as will be better understood from the ensuing description).

Each vehicle wheel is connected to an electric motor, which is, in turn, connected to an electric battery. When the vehicle travels through a station, an electrical contact charges the batteries, which lead the motors throughout the acceleration step and supply the vehicle onboard ancillary services (air conditioning, lighting, etc.) while travelling between two subsequent stations.

Accordingly, a cableway installation according to the present invention allows overcoming the limitations of a terrestrial transportation system while sharply increasing the potential of a conventional aerial system. Among the other advantages, the stations are extremely simple, as they only comprise the guide rails for the vehicles and opening/closure of the grips and doors, as well as devices for the deviation and/or devices for moving and tensioning the ropes. Thereby, since the station is no longer provided with any mechanical devices for moving the vehicles, nothing can cause the malfunctioning of the installation. For the same reason, the station cost is sensibly lower than with conventional installations. Further advantages will appear from the description below.

These and other objects and advantages will be achieved, according to one aspect of the invention, by means of a system having the characteristics defined in claim 1. Preferred embodiments of the invention are defined in the dependent claims.

BRIEF DESCRIPTION OF THE DRAWINGS

The functional and structural features of several preferred, though non-limiting, embodiments of a cableway installation according to the invention will be now described. Reference will be made to the annexed drawings, in which.

DETAILED DESCRIPTION

Figure 1:
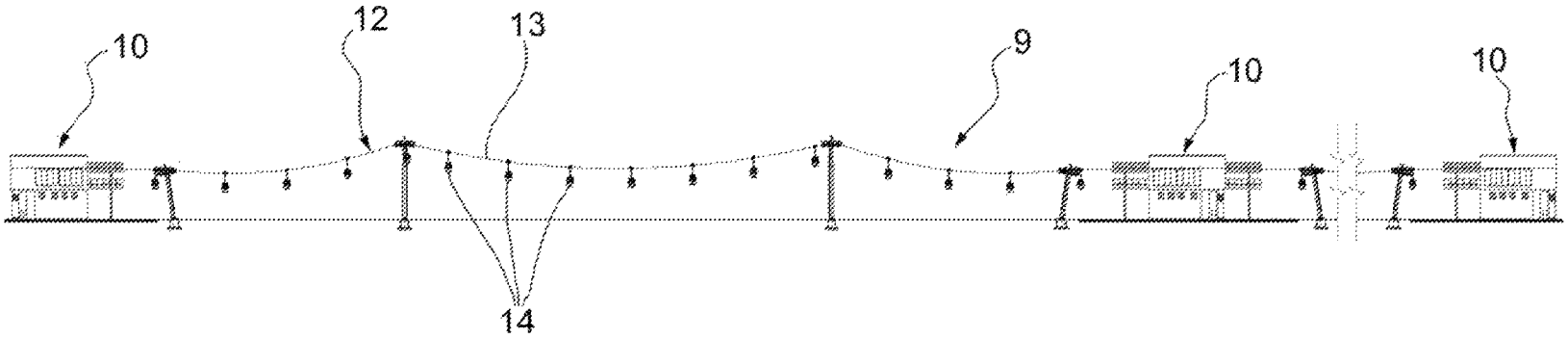
FIG. 1 is a schematic side view of a cableway according to an embodiment of the invention.

Referring first to FIG. 1, a continuously moving cableway, generally designated at 9, comprises a plurality of stations for passenger access 10 which are mutually connected by means of line sections 12, which generally define a suitable path for the circulation of suspended vehicles 14.

Figure 3:
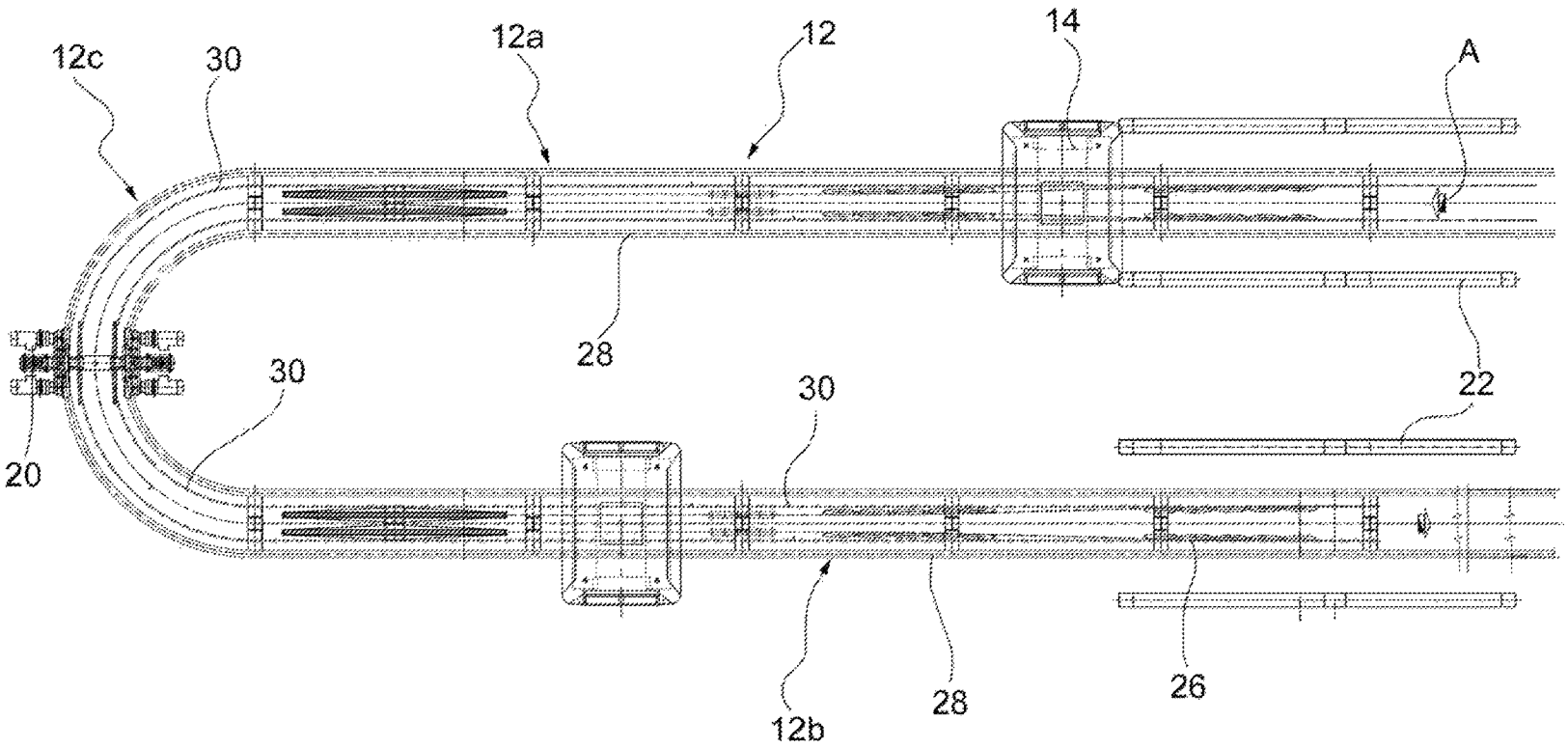
FIG. 3 is a plan schematic view of a further detail of a cableway, according to an embodiment of the invention.

The line 12 comprises two parallel line sections 12*a*, 12*b* along which the vehicles 14 travel in either direction. The two line sections can be joined by means of a curved section 12*c*, as can be seen in FIG. 3, in which a detail of a line end section is illustrated, which is conveniently located at a terminal station for passenger access.

Preferably, the line comprises a pair of ropes 13*a*, 13*b*, each pair being associated to a movement direction of the suspended vehicles 14. The haul rope is driven into continuous motion by a motor member (usually a pulley, not illustrated herein).

The solution proposed in the example illustrated herein provides two carrying-hauling ropes 13*a* and 13*b*, which act both as haulage and support of vehicles. This arrangement, though being preferred for the reasons that will be better detailed below, should not be considered as limiting. Further arrangements known in the art can be used, such as an individual carrying-hauling rope and multiple-rope systems with carrying ropes and hauling ropes.

By having two paired ropes supporting the vehicle, as in the example illustrated herein, the following advantages are obtained:

- the two ropes substantially stabilise the vehicle, thereby considerably reducing the possible transversal oscillations in the line and reducing these oscillations to zero upon passing on the supports;
- the reduction in these oscillations allows providing installations with minor track spacing and, accordingly, stations and supports with a small width;
- the transit on roller assemblies is carried out with the grips in a certain position, i.e. not tilted, which allows providing rope holding and guiding devices on the outer side, such as to prevent the derailment in both operating and non-operating conditions;
- the two ropes determine the position of the vehicles both when the latter pass on the supports and enter a station; accordingly, tilting and dangerous oscillations cannot occur even under strong wind conditions or anomalous passenger behaviour;
- particularly, by progressively guiding and leading the vehicle's attitude for entering a station, by means of the two guiding ropes, the impact occurring in the traditional cablecars when the so-called "third wheel" comes in contact with attitude stabilisation guide is prevented, thus allowing, inter alia, to reach a higher operating speed than with traditional cablecars.

Figure 2:
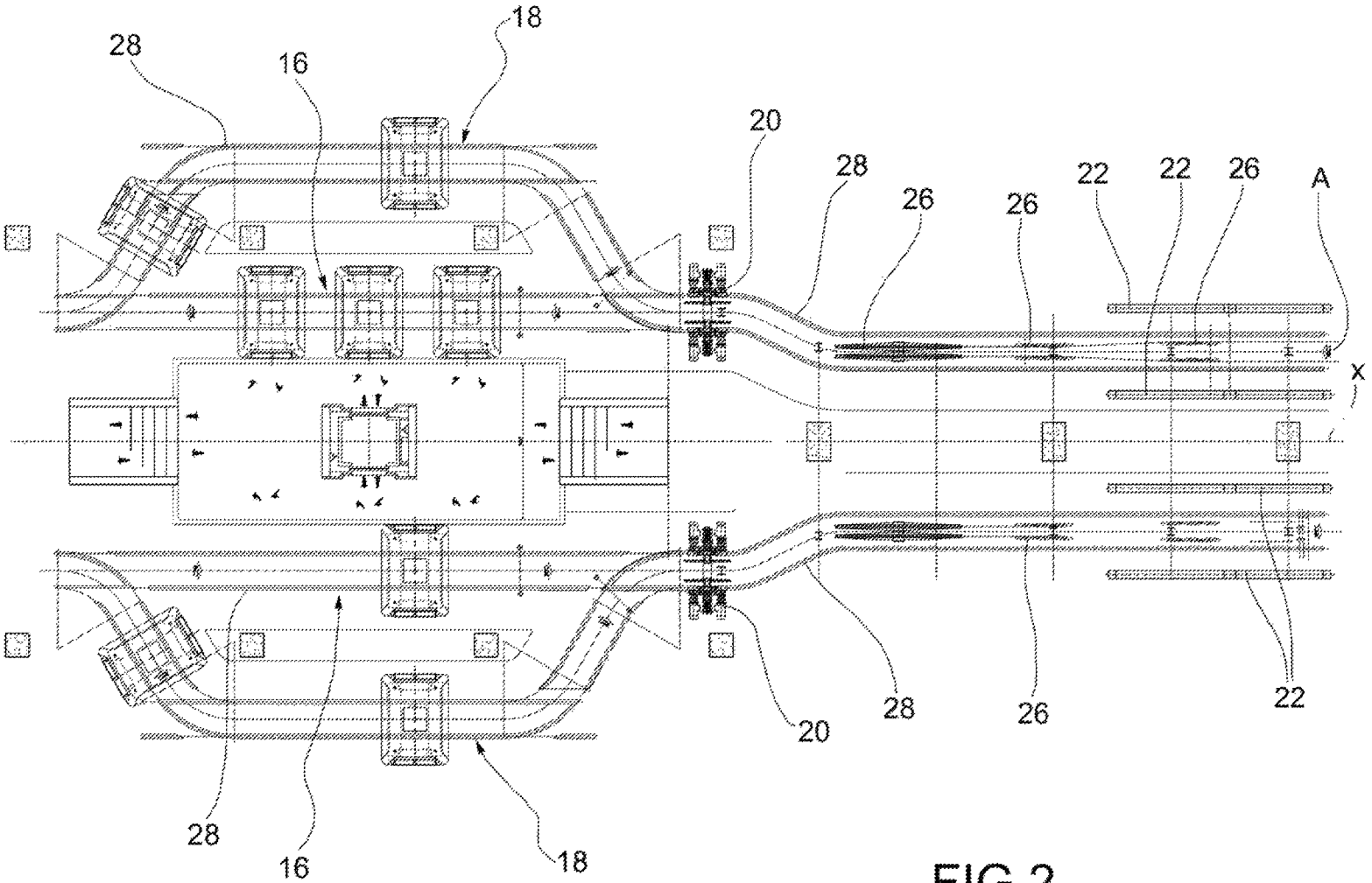
FIG. 2 is a plan schematic view of a detail of the cableway in FIG. 1.

FIG. 2 is an exemplary embodiment of a station 10 for passenger boarding or disembarking. The station 10 preferably comprises a duplicity of sections or stops 16, located on opposite sides of a longitudinal centerline axis x of the line, inside which the vehicles are caused to slow down or stop to allow passenger access. The stops 16 can be either located along an extension of the line branches, in the two travelling directions of the vehicles along the path 14, or they can be located in a different position, which can be reached by the vehicles by means of switches or turnouts allowing the vehicles to travel in different points of the station.

On the sides of the stop 16, there can be a vehicle parking or recovery section 18, such as illustrated in FIG. 2, by way of example, where the vehicles, either damaged or unnecessary because in excess of the traffic requirements of the line, can be parked. This results in an advantage that, on the one hand, it allows clearing the line from any faulty vehicle, without affecting the operativity of the transportation line. This also ensures high flexibility in managing the passenger hourly flows, which can be adjusted according to public transportation needs.

The conventional rigidity of cableways with suspended vehicles, where a number of vehicles results to be clamped to the line rope regardless of the actual number of passengers, which causes an energy waste due to the requirement of maintaining an installation with a number or vehicles in excess, is thus overcome.

Instead of, or in addition to the parking branches 18, braking branches 16 can be provided which are not aligned relative to the afferent branches 12*a*, 12*b* of the transportation line (according to an embodiment not illustrated herein). This allows displacing the passenger access point to a remote position from the line. The advantage of this arrangement is the possibility of having an access point for the passengers which does not produce excessive vibrational or noise stresses, which are closely related to the line operation. As a result, these access points may be positioned near buildings or structures that can be used by the public without the discomfort generated from said stresses.

A motor-driven trolley 20 is mounted on board the vehicle to facilitate the movement of the vehicles inside the stations, as will be explained below.

With further reference to FIG. 2, a suspended vehicle 14 coming from a line branch according to the travel direction indicated, for example, by the arrow A, first meets one, or preferably two clamping/releasing ramps 22, known per se. The ramps have a consecutively descending and ascending profile in a vertical plan. Automatic coupling devices 24, integral with the motor-driven trolley 20, are engaged such that the profile of the ramps 22 acts on a spring system 24*a*, comprised in the clamping device 24, causing the release of a jaw 24*b* from the rope.

The rope, or in the case illustrated herein, the pair of ropes in the line, is subsequently conveyed, directed and tensioned by a plurality of rollers or deviation/tensioning pulleys 26.

In a preferred embodiment of the installation, the station is provided with a pair of to overhead rails 28, which define a support and sliding surface for the motor-driven trolley 20 of the various suspended vehicles. These rails can have paths that are either curvy or have curvilinear lengths. The rails may be mutually joined to other rails by means of switches or turnouts, which allow the vehicles to travel between different sections of the station, such as the above-mentioned parking and maintenance sections or the stop sections located in a remote position from the line.

By means of these deviations, even more than one line 12 can be directed into the same passenger access station. This allows providing an integrated line network developing along paths having different directions, such as to meet the requirements of a capillary urban transportation network.

FIG. 3 illustrates a possible terminal section of a line 12, which is preferably located near a station 1. The two branches 12*a*, 12*b* of the same line, corresponding to the two opposite travel directions in the path, are joined by means of a terminal curvilinear section 12*c*, which allows inverting the vehicle travelling direction.

In an embodiment, a pair of electrical wires 30 follows the line section within the stations 10 or along the terminal sections (as can be seen in FIG. 3), such as to supply electric power to the vehicles as will be better described herein below.

Figure 4B:
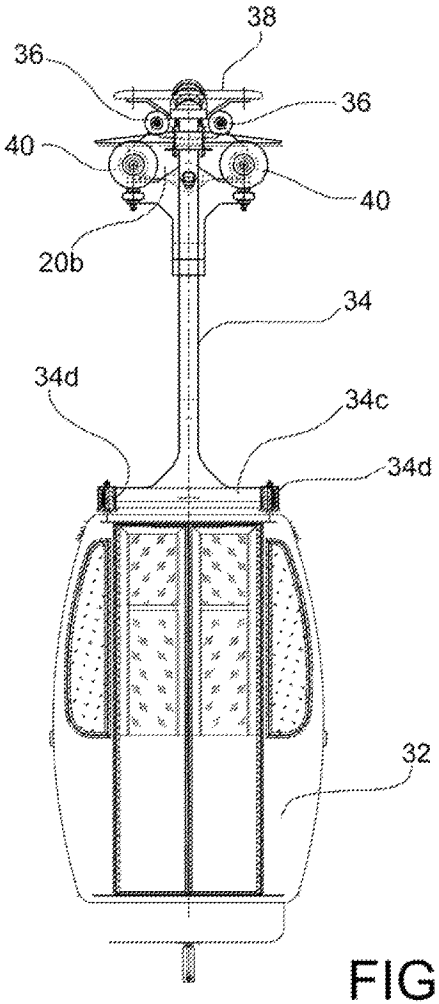
FIGS. 4A and 4B are a front schematic view and a side schematic view of a suspended vehicle, respectively, according to an embodiment of the invention, which is suitable to circulate within a cableway according to the invention.
Figure 4A:
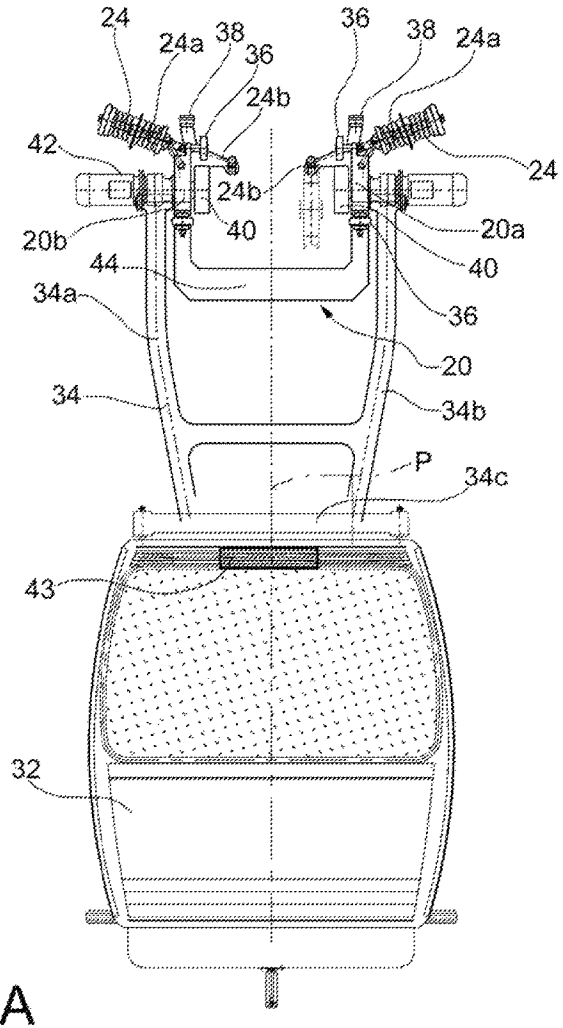

FIGS. 4A and 4B show an embodiment of a suspended vehicle 14 comprising the motor-driven trolley 20 and a means 32 for transporting passengers, which are connected by means of a suspension member 34. In the example illustrated herein, the suspension member 34 has two arms 34*a*, 34*b* spaced along a transversal direction to increase the vehicle stability during the movement thereof.

In an alternative embodiment (not illustrated herein), the suspension member 34 may have a single arm.

Furthermore, in the example illustrated herein, the passenger transporting means 32 is a cabin for a gondola lift system. However, other solutions are not excluded, such as for example a chairlift seat.

Conveniently, the motor-driven trolley 20 has a mirror-like structure relative to a vertical plane P, passing from the centerline of the cabin 32. This configuration allows, together with the shape of the suspension member 34, obtaining an optimum rigidity and stability of the vehicle, by counteracting any torsional or flexural stress which is transmitted to the moving vehicle.

Throughout the present description and in the claims, the terms and expressions designating positions and orientations, such as "longitudinal", "transversal", "vertical" or "horizontal", should be referred to the centerline axis x of the line 12. The trolley 20 conveniently comprises two half-trolleys or longitudinal members 20*a*, 20*b* parallel to each other and extended in the longitudinal direction, which are located on opposite sides relative to the geometrical plane of vertical centerline P.

In an alternative embodiment, not illustrated herein, the trolley 20 can comprise a single longitudinal member.

On the half-trolleys 20*a*, 20*b*, two clamping devices 24 are mounted, which are provided with spring system 24*a* which, by acting on the jaws 24*b*, causes the clamping or release of the jaws from the ropes. Conveniently, the jaws 24*b* face the inside of the trolley 20 (as may be seen in FIGS. 4A, 5A and 5B), i.e. in a position close to the geometrical plane of vertical centerline P. The spring systems 24*a* face the outside of the trolley. This configuration results to be optimal, in that the passage of the ropes 13*a*, 13*b* inside the space laterally delimited by the half-trolleys 20*a*, 20*b*, allows maximising the transversal distance of the arms 34*a*, 34*b* of the suspension 34, to the benefit of the vehicle stability along the path.

Conveniently, the trolley 20 is provided with lateral guide wheels 36 and coupling slides 38 with the station safety devices.

A plurality of wheels 40, preferably tyred, are provided along the two symmetrical sides 20*a*, 20*b* of the trolley. One or more of said wheels 40 is a motor-driven wheel, by coupling to an electric motor actuator or member 42.

According to a preferred embodiment, the motor-driven trolley 20 is equipped with four motor-driven wheels 40, mounted in pairs on the half-trolleys 20*a*, 20*b*, such as to provide the vehicle with a traction that is either balanced or present even in case of failure of one or more wheels. In the example illustrated herein, the wheels 40 and the electric motors 42 thereof are mounted in pairs to each half-trolley, symmetrically with respect to a transverse centerline R of the motor-driven trolley.

However, the number of wheels can be other than four (e.g., only one wheel being provided to each half-trolley), although such configuration does not offer the same advantages as the solution described herein. In any case, it is preferred that at least one motor-driven wheel is provided on each half-trolley.

The lateral segments 20*a*, 20*b* of the trolley can be mutually connected by one or more reinforcement beams 44 (preferably C-shaped), such as to provide further rigidity to the trolley 20, such as not to transfer excessive stresses to the suspension member 34. In the example illustrated herein, a single C-section reinforcement beam 44 is provided.

Figure 5C:
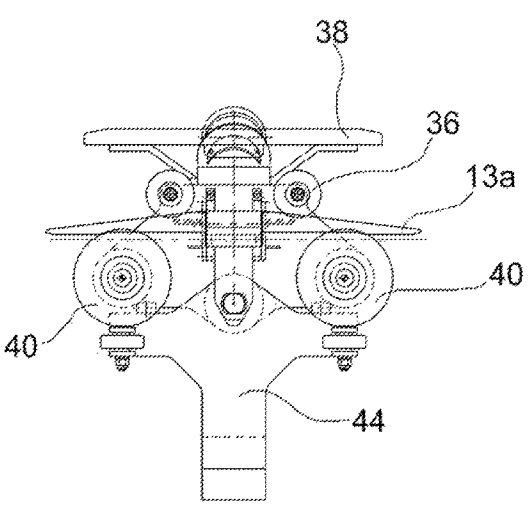
FIGS. 5A, 5B and 5C are a front schematic view, a top schematic view and a side schematic view, respectively, of a detail of the vehicle illustrated in FIGS. 4A and 4B.
Figure 5A:
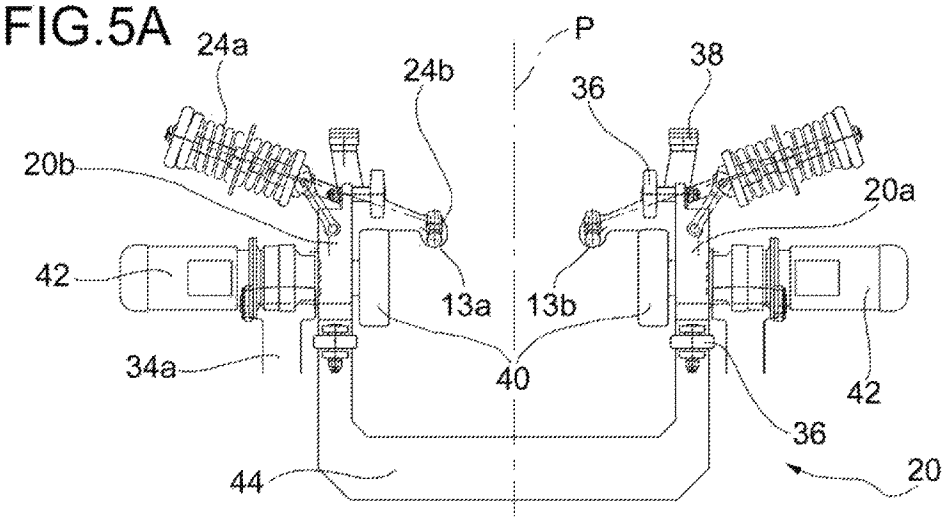
Figure 5B:
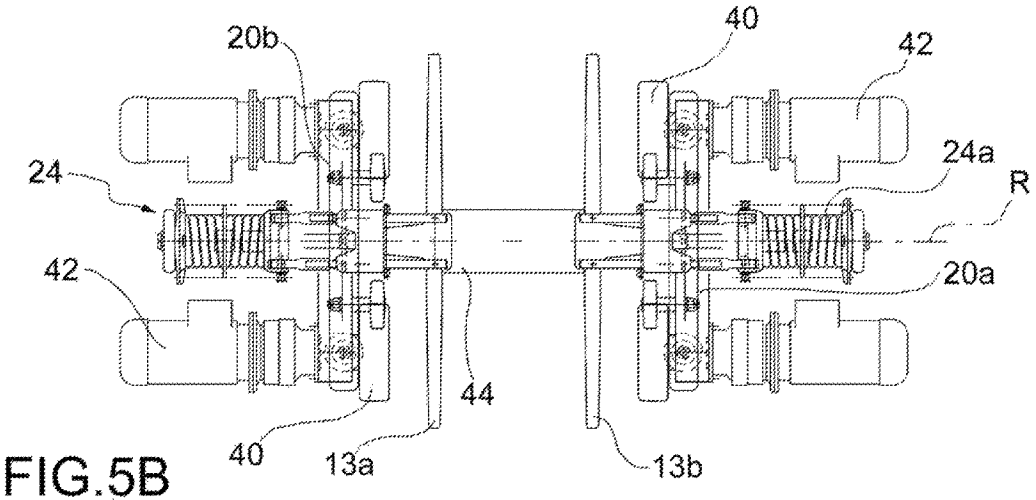

In an embodiment, the single reinforcement beam 44 is fastened to the motor-driven trolley at the intersection points between the lateral half-trolleys 20*a*, 20*b* and the transverse centerline R of the motor-driven trolley, such as to provide the trolley 20 with a H-structure as viewed from above (FIG. 5B).

As stated above, the suspension member has two arms 34*a*, 34*b*, hinged to the motor-driven trolley preferably near the intersection points between the lateral half-trolleys 20*a*, 20*b* and the transverse centerline R of the motor-driven trolley 20. The same position of the hinge might be obtained, relative to the longitudinal member 20*a*, 20*b*, when a single arm 34*a*, 34*b* is provided.

The provision of the rotational fastening between the trolley and suspension, in the position thus determined, offers the advantage of balancing the forces exchanged between the ropes 13*a*, 13*b* and the cabin 32 in an optimum manner. The suspension member 34 can be fastened to the cabin 32 by means of one or more fastening brackets 34*c*, which might be provided with elastic and/or dampening elements 34*d* for reducing the transmission of vibrations and stresses from the suspension to the cabin.

FIGS. 5A to 5C show an enlarged view of the motor-driven trolley 20, wherein the motor-driven wheels 40, the motorized electrical elements 42 connected to the wheels, the clamping devices 24, with the jaws thereof engaged on the ropes 13*a*, 13*b*, the lateral guide wheels 36, and the reinforcement beam 44 are illustrated. As stated above, FIG. 5B shows a top schematic view of the motor-driven trolley, wherein the two lateral half-trolleys 20*a*, 20*b* can be seen, to which the motor-driven wheels and electric motors 42 thereof are mounted.

Furthermore, the positioning of the clamping device 24 along the transverse centerline R of the motor-driven trolley, i.e. in an intermediate position between two electric drives 42 of a half-trolley, provides a more compact and balanced structure of the trolley 20.

Conveniently, the suspended vehicle 14 is electrically powered, upon passing and stopping inside the stations, by means of the electric conductors 30, such that batteries (schematically designated with 43 in FIG. 4A) mounted on the vehicle are charged with electric energy. In the embodiment illustrated herein, the electric conductors 30 are a pair of mutually parallel and transversally spaced conductors (as can be seen in FIG. 2).

However, the number of conductors 30 can be other than two, since one or more conductors may be provided, according to requirements.

Electric power is distributed to the electric motors connected to the wheels, such that the wheels are capable of exerting a traction force on the vehicle, when the vehicle travels inside a station.

Figures 6A, 6B:
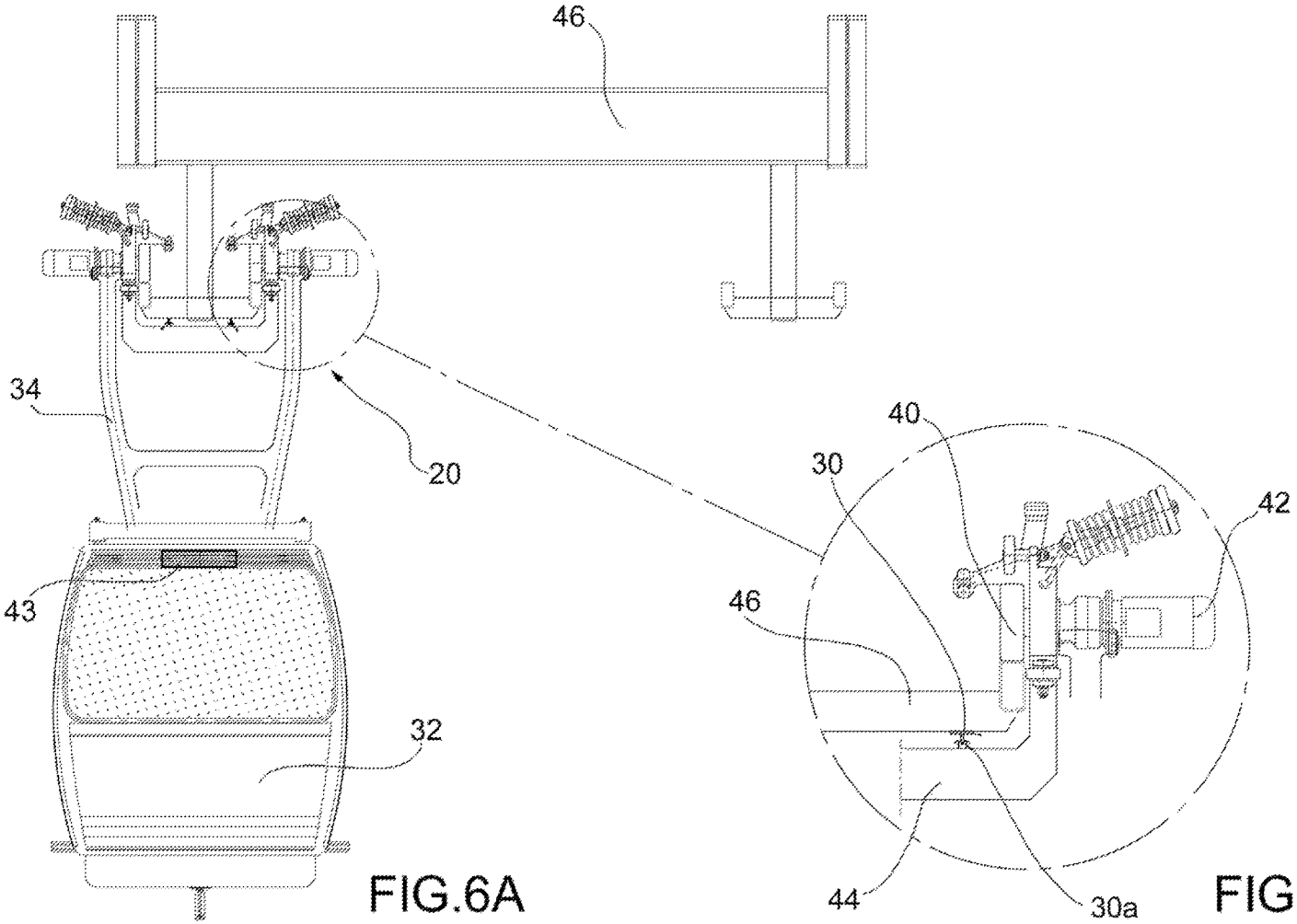
FIGS. 6A and 6B are a front schematic view of a vehicle suspended from a powered support beam, and a detail of FIG. 6A, respectively.

FIGS. 6A and 6B show an embodiment of the vehicle electric power, comprising the first stationary conductor 30 (FIG. 6B), integral with a beam 46 for supporting the vehicle. Conductor 30 is coupled by means of a sliding or moving-conductor contact 30*a*, which is integral with the motor-driven trolley, preferably with the reinforcement beam 44. The batteries 43 can be also recharged during the vehicle slowing down step in the stations.

In another embodiment, not illustrated herein, the batteries are charged in a very short time by means of a power plug which is inserted into an electric power source, provided in the station, such that the batteries are charged in a few seconds. A similar solution can use supercapacitors, i.e. devices for energy conversion and accumulation characterised by high specific powers and by the possibility of being almost instantaneously charged or discharged. In this case, it is not required that the fixed conductor 30 extends, even without interruption, between the ends of the station and/or sections of the line 12 near the station. Rather, it is sufficient for the conductor (or conductors, in case more than one are provided) to be located in a point or circumscribed area within the station and/or near thereto.

The recharge of the batteries when the vehicle travels in the station allows supplying the auxiliary services on board the vehicle (e.g., air conditioning, lighting, etc.) during the displacement of the vehicle from one station to another, as well as to actuate the wheels of the motor-driven trolley, in order to accelerate or decelerate the vehicle near or inside the station.

When the jaws of the clamping members, integral with the vehicle motor-driven trolley vehicle, are released from the line ropes, for example when entering a passenger access station, the vehicle remains suspended from the rails 28 only by means of the trolley wheels 40. The electric drives 42, by acting as generators, absorb energy from the wheels that, in this manner, act as brakes for the vehicle, while contributing to supply and charge the batteries by using the braking kinetic energy possessed by the vehicle by inertia.

On the other hand, when the vehicle has been sufficiently slowed down, or stopped, to allow the passengers access the cabin, the same electric drives 42 transfer to the wheels a traction torque which causes an acceleration of the vehicle, until the latter is taken to a suitable speed for re-clamping to the haul rope.

Thereby, since the motor-driven trolley wheels are autonomously capable of controlling the vehicle braking and acceleration, while passing through the stations, there is no need to have the braking and acceleration roller assembly which are provided in conventional installations.

In addition, several of the further advantages obtained by the invention are as follows:

- the stations are extremely simplified, with only the tracks for the vehicles to pass therealong, or can comprise other paths for halt and stabling, or accumulation and storage of vehicles;
- the technological characteristics of the installation allow locating stations in a curve and interchange stations where the vehicles can be directed towards different paths;
- in the stations, the vehicles can autonomously travel at low speed, along paths passing through different buildings and/or infrastructures, and the entry and exit points for the passengers can be located in remote positions from the rope clamping and release areas;
- these paths can have a curvilinear development and can have ascending and descending sections;
- the vehicle transit along these paths is noise-free and does not transmit vibrations to the buildings or structures.

Various aspects and embodiment of a continuously moving aerial cableway according to the invention have been described. It should be understood that each embodiment can be combined with any other embodiment. Furthermore, the invention is not limited to the embodiments described herein, but can be modified within the scope defined by the attached claims.

The invention claimed is:

1. A continuously moving aerial cableway, comprising:

at least one haul rope extending as a closed loop defining a path or transportation line;

a plurality of suspended vehicles releasably connectable to the haul rope through a plurality of automatic coupling devices, wherein the plurality of suspended vehicles comprises a passenger transporting means;

passenger stations arranged along the path of the haul rope for passengers alighting and boarding the plurality of suspended vehicles, wherein each passenger station includes:

ramps to cause clamping or release of the plurality of automatic coupling devices;

fixed electrical power supply contacts extending proximate to and/or within the passenger stations;

overhead rails extending proximate to and/or within the passenger stations;

and wherein on board of each of the plurality of suspended vehicles there is mounted:

at least one electrical contact, adapted to contact at least one of the fixed electrical power supply contacts of the passenger stations;

at least one electric battery;

a motor-driven trolley comprising two half-trolleys symmetrical with respect to a vertical plane (P) passing through a centerline of the plurality of suspended vehicles, wherein the passenger transporting means is mechanically connected to the motor-driven trolley through a suspension member having at least one arm, the motor-driven trolley including at least one electric drive and associated driving wheels adapted for rolling on the overhead rails for moving the plurality of suspended vehicles within and proximate to the passenger stations.

2. A cableway according to claim 1, wherein each half-trolley is provided with the plurality of automatic coupling devices and the at least one electric drive coupled to the associated driving wheel.

3. A cableway according to claim 1, wherein the haul rope is a carrying-hauling rope.

4. A cableway according to claim 1, comprising two carrying-hauling ropes.

5. A cableway according to claim 1, wherein the at least one arm of the suspension member is hinged to the motor-driven trolley proximate to an intersection point between the half-trolley and a transverse centerline (R) of the motor-driven trolley.

6. A cableway according to claim 1, wherein the suspension member comprises two transversally spaced arms.

7. A cableway according to claim 6, wherein the plurality of automatic coupling devices provide jaws located within a space delimited laterally by the half-trolleys.

8. A cableway according to claim 1, wherein the passenger transporting means is a cabin or a gondola.

9. A cableway according to claim 1, wherein each passenger station does not comprise motor means for accelerating or decelerating or causing the plurality of suspended vehicles to transit.

* * * * *